US012533551B2

(12) United States Patent
Nolan et al.

(10) Patent No.: US 12,533,551 B2
(45) Date of Patent: Jan. 27, 2026

(54) HORIZONTAL PENDULUM SQUAT SYSTEM

(71) Applicant: Bulletproof Fitness Equipment Inc, Acton, CA (US)

(72) Inventors: Lawrence R. Nolan, Santa Clarita, CA (US); Christopher I. Gaddy, Brooklyn, NY (US); Nicole K. Nolan, Santa Clarita, CA (US)

(73) Assignee: Bulletproof Fitness Equipment Inc, Acton, CA (US)

( * ) Notice: Subject to any disclaimer, the term of this patent is extended or adjusted under 35 U.S.C. 154(b) by 100 days.

(21) Appl. No.: 18/651,980

(22) Filed: May 1, 2024

(65) Prior Publication Data

US 2024/0366998 A1 Nov. 7, 2024

Related U.S. Application Data

(60) Provisional application No. 63/499,294, filed on May 1, 2023.

(51) Int. Cl.

| | |
|---|---|
| ***A63B 23/04*** | (2006.01) |
| ***A63B 21/00*** | (2006.01) |
| ***A63B 21/06*** | (2006.01) |

(52) U.S. Cl.

CPC ..... *A63B 23/0405* (2013.01); *A63B 21/0615* (2013.01); *A63B 21/4029* (2015.10); *A63B 21/4034* (2015.10); *A63B 21/4035* (2015.10); *A63B 2023/0411* (2013.01); *A63B 2208/0252* (2013.01)

(58) Field of Classification Search

CPC ..... A63B 21/0615; A63B 21/4029; A63B 21/4034; A63B 21/4035; A63B 21/4047; A63B 23/03525; A63B 23/0405; A63B 2023/0411; A63B 2208/0252; A63B 2244/09

See application file for complete search history.

(56) References Cited

U.S. PATENT DOCUMENTS

| | | | | |
|---|---|---|---|---|
| 4,511,137 A * | 4/1985 | Jones | A63B 21/06 482/142 |
| 4,589,658 A * | 5/1986 | Gibson | A63B 21/4001 482/97 |
| 4,645,205 A * | 2/1987 | Wolff | A63B 21/4029 482/138 |

(Continued)

*Primary Examiner* — Gary D Urbiel Goldner
(74) *Attorney, Agent, or Firm* — Avek IP, LLC

(57) ABSTRACT

A horizontal pendulum squat system includes a frame structure having at least one or more bottom members and one or more substantially vertical members supporting a cross bar; a weight pivoting system supported by the cross bar to rotate at one or more connection points with the cross bar, the weight pivoting system having weight arms connected at the connection points such that the weight arms can rotate about the connection points; and at least one platform coupled to the weight arms, the at least one platform is to receive a user applied force; a bench positioned substantially underneath the weight pivoting system; the platform is positioned to receive the user applied force while the user is lying on the bench and applying the force with their legs and feet against the platform; and the weight pivoting system rotates around the connection points during repetitive motion by the user.

14 Claims, 6 Drawing Sheets

(56) References Cited

U.S. PATENT DOCUMENTS

| | | | | |
|---|---|---|---|---|
| 4,674,160 | A * | 6/1987 | Gibson | A63B 21/4047 482/97 |
| 5,628,715 | A * | 5/1997 | Simonson | A63B 21/4047 482/137 |
| 6,802,800 | B1 * | 10/2004 | Hobson | A63B 21/4047 482/137 |
| 2009/0192026 | A1 * | 7/2009 | Mason | A63B 21/4035 482/97 |
| 2016/0346586 | A1 * | 12/2016 | Pullins | A63B 21/4033 |
| 2017/0203149 | A1 * | 7/2017 | D'Amico | A63B 21/0615 |

* cited by examiner

HORIZONTAL PENDULUM SQUAT SYSTEM

RELATED APPLICATIONS

This application claims priority to U.S. Provisional Application No. 63/499,294, filed May 1, 2023, which is incorporated by reference in its entirety herein.

FIELD OF INVENTION

The disclosure relates generally to exercise equipment. More specifically, the disclosure relates to a horizontal pendulum squat system that provides for a pendulum squat exercise in a substantially horizontal position, providing a user with the ability to add weight or counterweight to create resistance that is suitable for their specific physical needs.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

According to an embodiment of the current disclosure, the invention includes a horizontal pendulum squat system having a frame structure with at least one or more bottom members and one or more substantially vertical members supporting a cross bar; a weight pivoting system supported by the cross bar and configured to rotate at one or more connection points with the cross bar; and a bench positioned substantially underneath the weight pivoting system. The weight pivoting system includes one or more weight arms connected at the one or more connection points such that the one or more weight arms can rotate about the one or more connection points; and at least one platform coupled to the one or more weight arms, the at least one platform is configured to receive a user applied force. The platform is positioned to receive the user applied force while the user is lying on the bench and applying the force with their legs and feet against the platform; and the weight pivoting system rotates around the one or more connection points during repetitive motion by the user.

BRIEF DESCRIPTION OF THE DRAWINGS

Embodiments of the invention are described in detail below with reference to the attached drawings.

LIST OF REFERENCES

Figure 1:
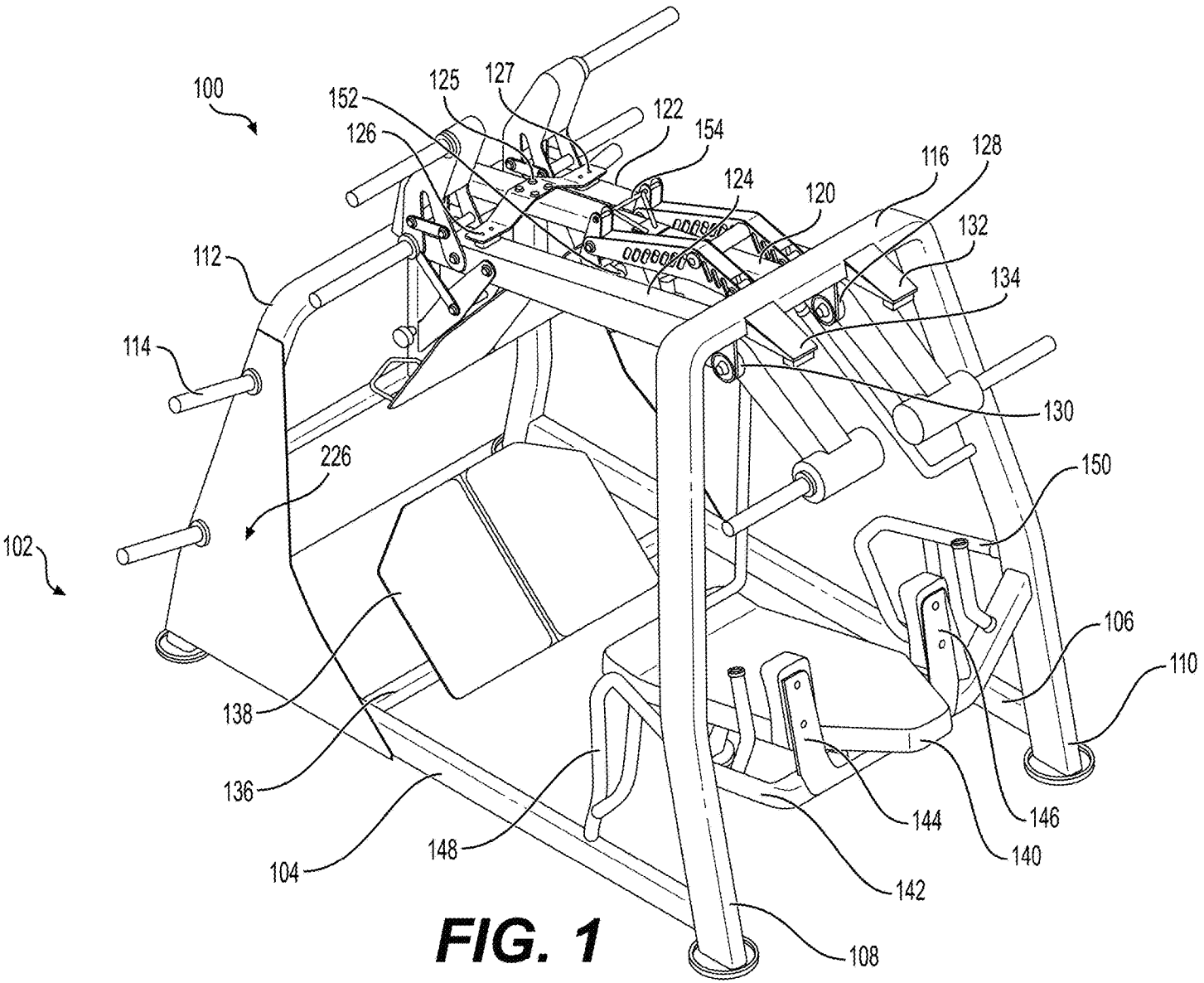
FIG. 1 is a top perspective view of a horizontal pendulum squat system in accordance with the present invention.

100—Horizontal Pendulum Squat System
102—Frame Structure
104—First Bottom Member
106—Second Bottom Member
108—First Rear Member
110—Second Rear Member
112—Front
114—Weight Storage Bar(s)
116—Cross Bar
118—Weight Pivoting System
120—Support Bar
122—First Weight Arm
124—Second Weight Arm
125—Stop Bracket
126—First Bracket Bumper
127—Second Bracket Bumper
128—First Hinge
130—Second Hinge
132—First Bumper
134—Second Bumper
136—Lower Cross Bar
138—Stationary Foot Platform
140—Bench
142—Bench Support Bar
144—First Shoulder Pad
146—Second Shoulder Pad
148—Side Handle Assembly
150—Second Side Handle Assembly
152—Catch Bar
154—Mount
200—Counterweight Receiver
201—Rear Arm Extension
202—Upper Weight Receiver
204—Lower Weight Receiver
206—Brace
208—Foot Plate
210—Foot Plate Support Member
212—Latch System
214—Catch Arm
216—Catch
217—Handles
218—Pivot Connection
219—Pitovot Connection
220—Shelves
221—Handle
222—Bar
224—Groove(s)
225—Side Panel(s)
226—Plurality of Notches The drawings do not limit the invention to the specific embodiments disclosed and described herein. The drawings are not necessarily to scale, emphasis instead being placed upon clearly illustrating various principles of the disclosure.

DETAILED DESCRIPTION

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Exercise equipment is well known in the art and varies from complex machinery to simple devices, wherein a user may select various equipment based on their needs. One type of known exercise is a "pendulum squat", which is a variation of a classic squat exercise, and utilizes a machine that has a counterbalance mechanism to allow a user to perform squats in an arc-like motion. Pendulum squats are particularly effective at engaging a user's quadriceps, glutes, adductors, and calves, while reducing spinal strain. One common drawback to pendulum squats is that a user must lift their bodyweight during the exercise, which may be limiting to some individuals.

Accordingly, the present invention provides for a horizontal pendulum squat system that positions a user relatively below a weight pivoting system, such that the user does not have to lift their own weight, and instead can add or remove weighted resistance to fully customize the desired weight. This allows for reduced stress on the user's knees and backs, while providing the beneficial muscle engagement of a conventional pendulum squat.

The present invention includes a frame structure, which may vary as would be understood by those skilled in the art, wherein the frame structure supports a weight pivoting system in a substantially horizontal configuration with respect to a ground surface, with a bench positioned underneath the weight pivoting system. A user can engage with the weight pivoting system to perform a horizontal pendulum squat with reduced strain on their knees and back. In addition, the system may be adapted to provide unilateral movement, wherein the user may engage one leg at a time.

The horizontal pendulum squat system 100 is shown in FIGS. 1 through 6 from various angles. The system 100 includes a frame structure 102 with the primary purpose of supporting a weight pivoting system 118 above a position of a user (i.e. as the user lies on a bench 140). In embodiments, the frame structure 102 includes a first bottom member 104 and a second bottom member 106 which extend from a front 112 to first and second rear members 108, 110. The bottom members 104, 106 may lie directly on a ground surface, or alternatively may extend between feet that support the system 100 on the ground surface. The feet may be self level9ing feet such that the system 100 can maintain structural soundness on uneven ground. The overall dimensions of the frame structure 102 can also vary as would be clearly understood by those skilled in the art. Weight storage bars 114 extend from the frame structure 102 to provide easy and convenient storage of weights. Although the weight storage bars 114 are shown in two pairs (i.e. one pair per side), those skilled in the art will appreciate that additional or fewer weight storage bars may be present.

The rear members 108, 110 extend upward to opposing sides of a cross bar 116, the cross bar 116 providing primary support for the weight pivoting system 118. Another support bar 120 extends substantially perpendicular to the cross bar 116 and substantially from the front end to the rear end of the frame structure 102.

The weight pivoting system 118 includes a first weight arm 122 and a second weight arm 124 each independently coupled to the cross bar 116 via hinges 128, 130. The hinges 128, 130 can be created through any type of connection that allows for the arms 122, 124 to rotate about the cross bar 116 as the user applies repetitive motion to the arms. Accordingly, the arms 122, 124 can rotate around the cross bar 116 (see FIGS. 5 and 6). The arms 122, 124 are prevented from over rotation in both directions. First, a stop bracket 125 is mounted to a top surface of the support bar 120 and extends outwardly therefrom, having a first bracket bumper 126 and a second bracket bumper 127. These bumpers 126, 127 prevent the arms 122, 124 from rotating there past, such as if too much force were exerted by a user against the arms 122, 124. Similarly, first and second bumpers 132, 134 extend rearward from the cross bar 116 such that the arms 122, 124 cannot rotate too far in a downward motion. For example, should the user disengage from the weight pivoting system 118 without locking the weight pivoting system 118 in the extended position, the arms 122, 124 would not fully fall and potentially land on or harm the user, as they would be stopped via the bumpers 132, 134.

In embodiments, a lower cross bar 136 extends between the first and second bottom members 104, 106 and provides support to a stationary foot platform 138. The stationary foot platform 138 is particularly useful in a unilateral movement. For example, the user may rest their left foot and leg on the stationary foot platform 138, and engage their right leg only with the weight pivoting system.

Similarly, a bench support bar 142 extends between the first and second rear members 108, 110 and provides support for the bench 140. In embodiments, the support bar 142 has a substantially horizontal middle portion and two side portions that extend upward to the first and second rear members 108, 110. The bench 140 can vary in style and design as would be understood by those skilled in the art. Shoulder pads 144, 146 are attached to the bench support bar 142 and extend on either side of the bench 140, thereby providing resistance to the user's body as the user engages with the weight pivoting system 118. Various handle assemblies may be used, such as a first side handle assembly 148 and a second side handle assembly 150, each positioned on alternate sides of the bench 140.

Figure 2:
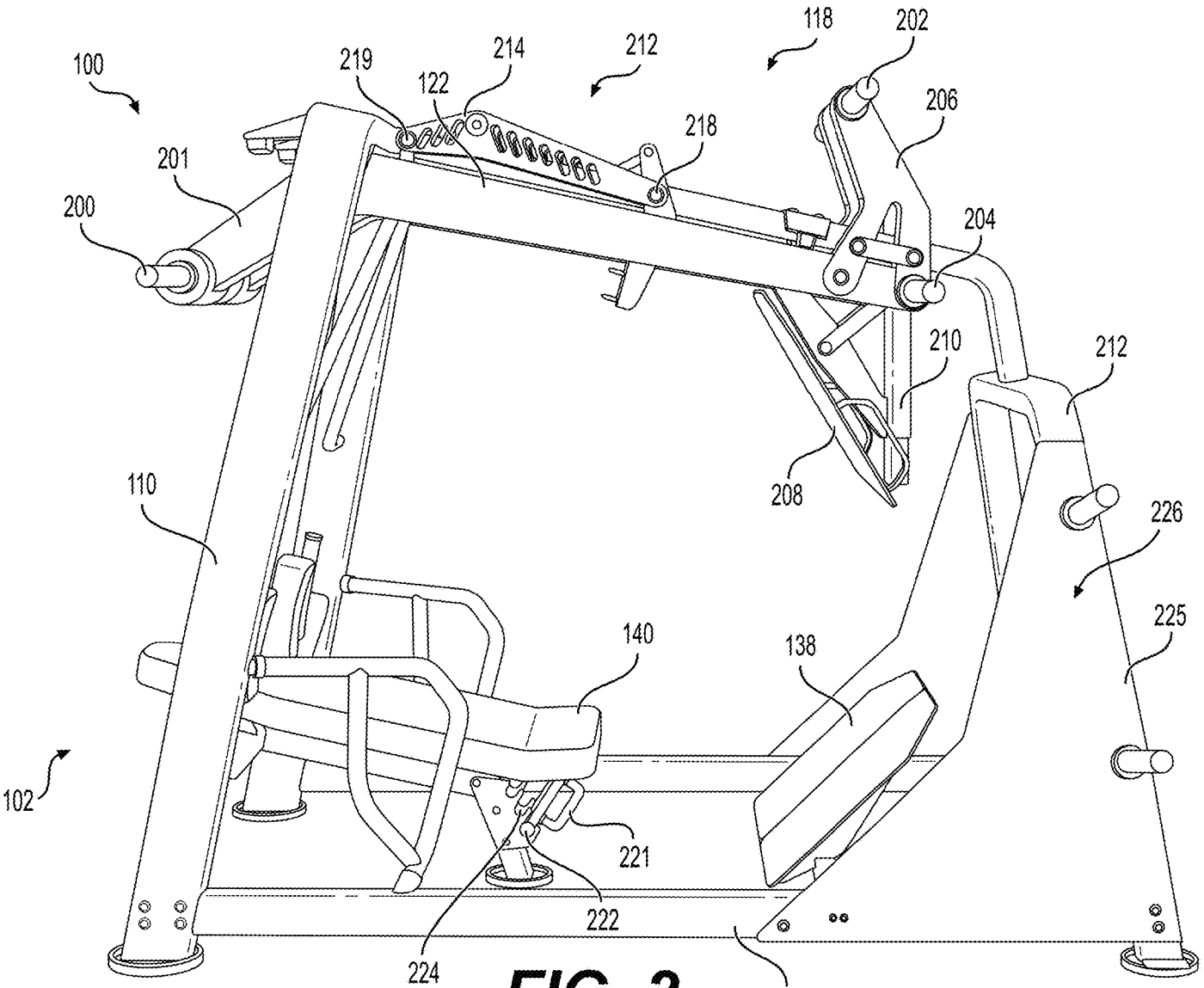
FIG. 2 is a side view of the horizontal pendulum squat system of FIG. 1.
Figure 3:
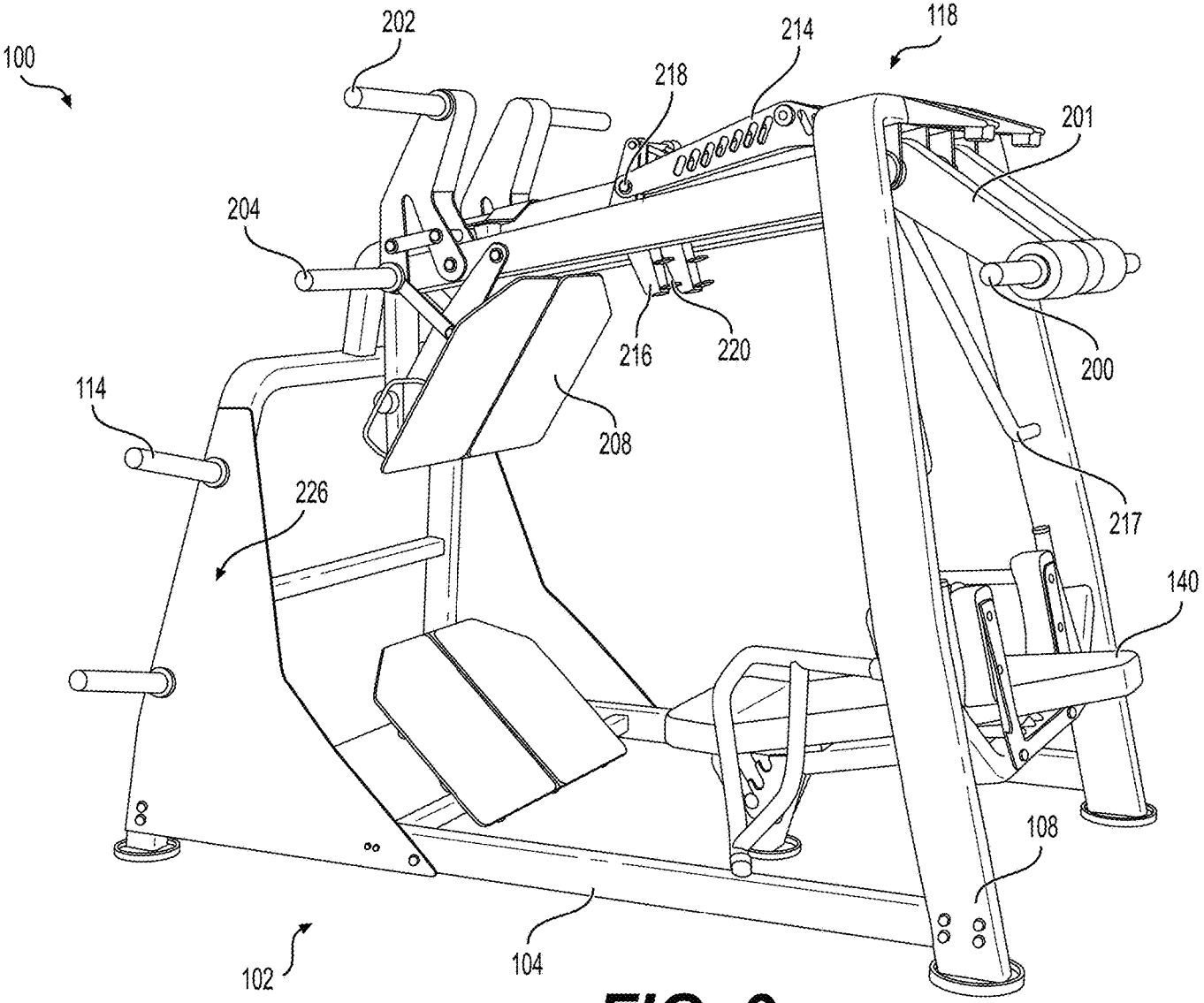
FIG. 3 is a side perspective view of the horizontal pendulum squat system of FIG. 1.
Figure 4:
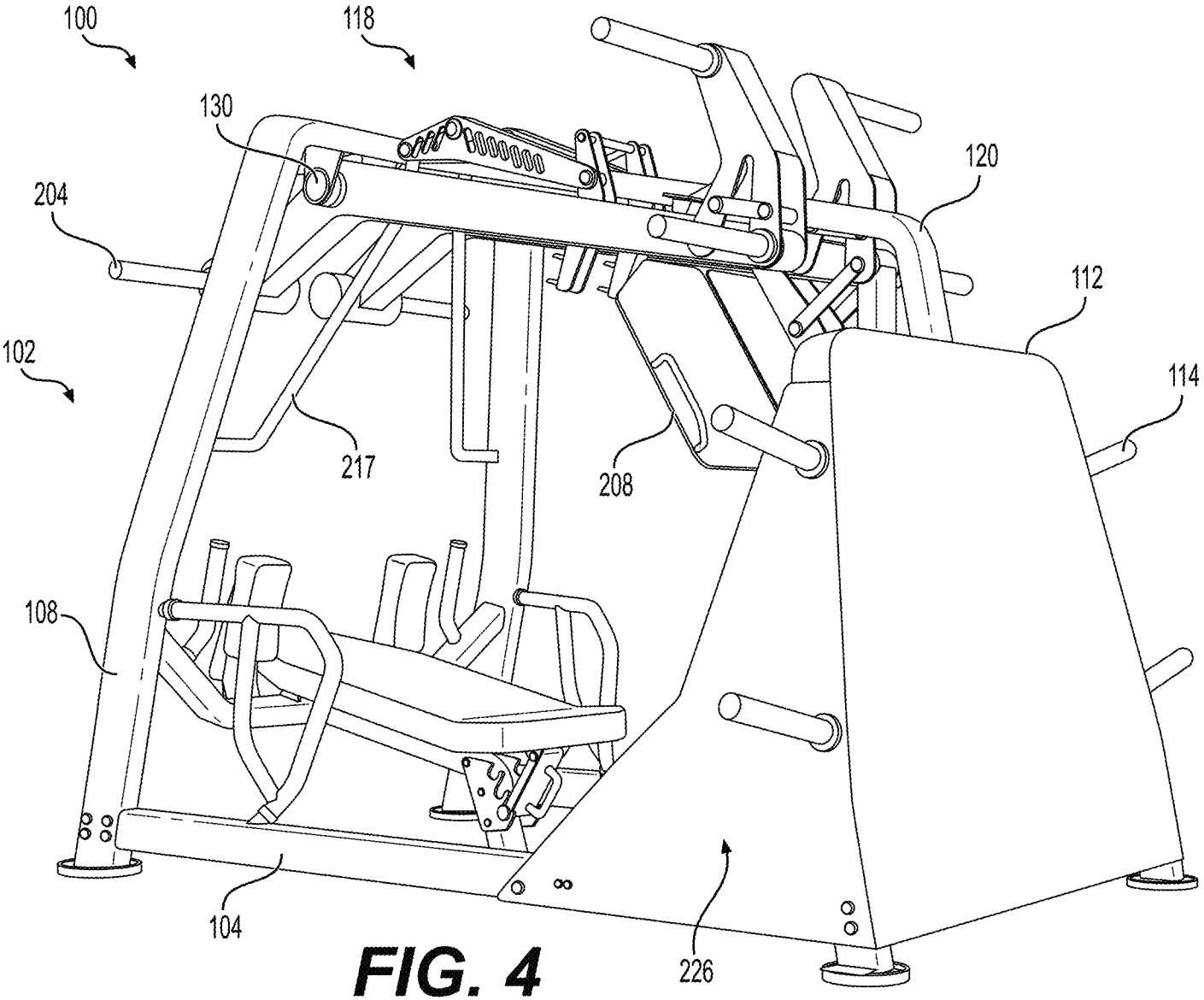
FIG. 4 is another side perspective view of the horizontal pendulum squat system of FIG. 1.
Figure 5:
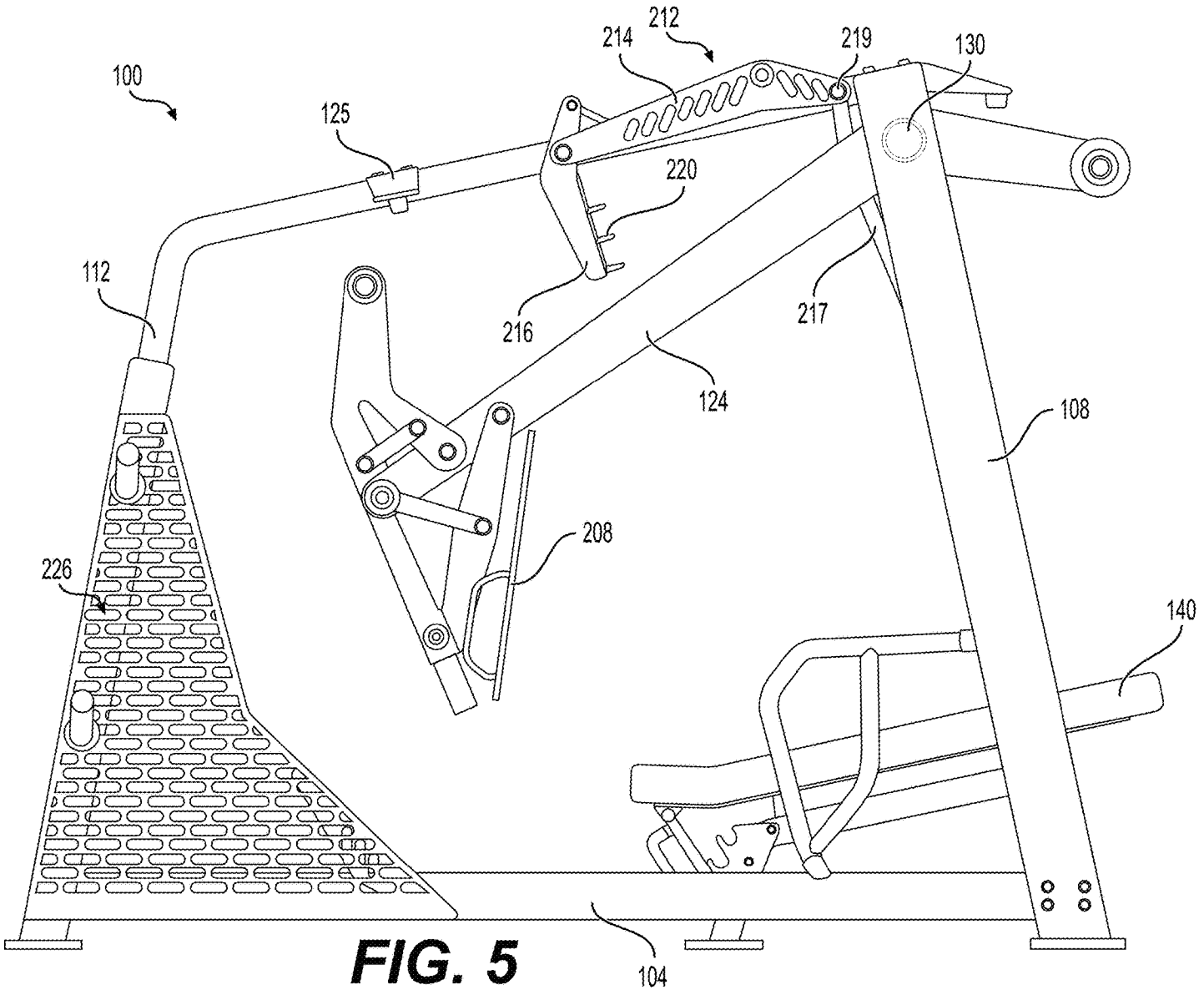
FIG. 5 is a side view of the horizontal pendulum squat system with a weight pivoting system in a starting position and disengaged from a latch system.
Figure 6:
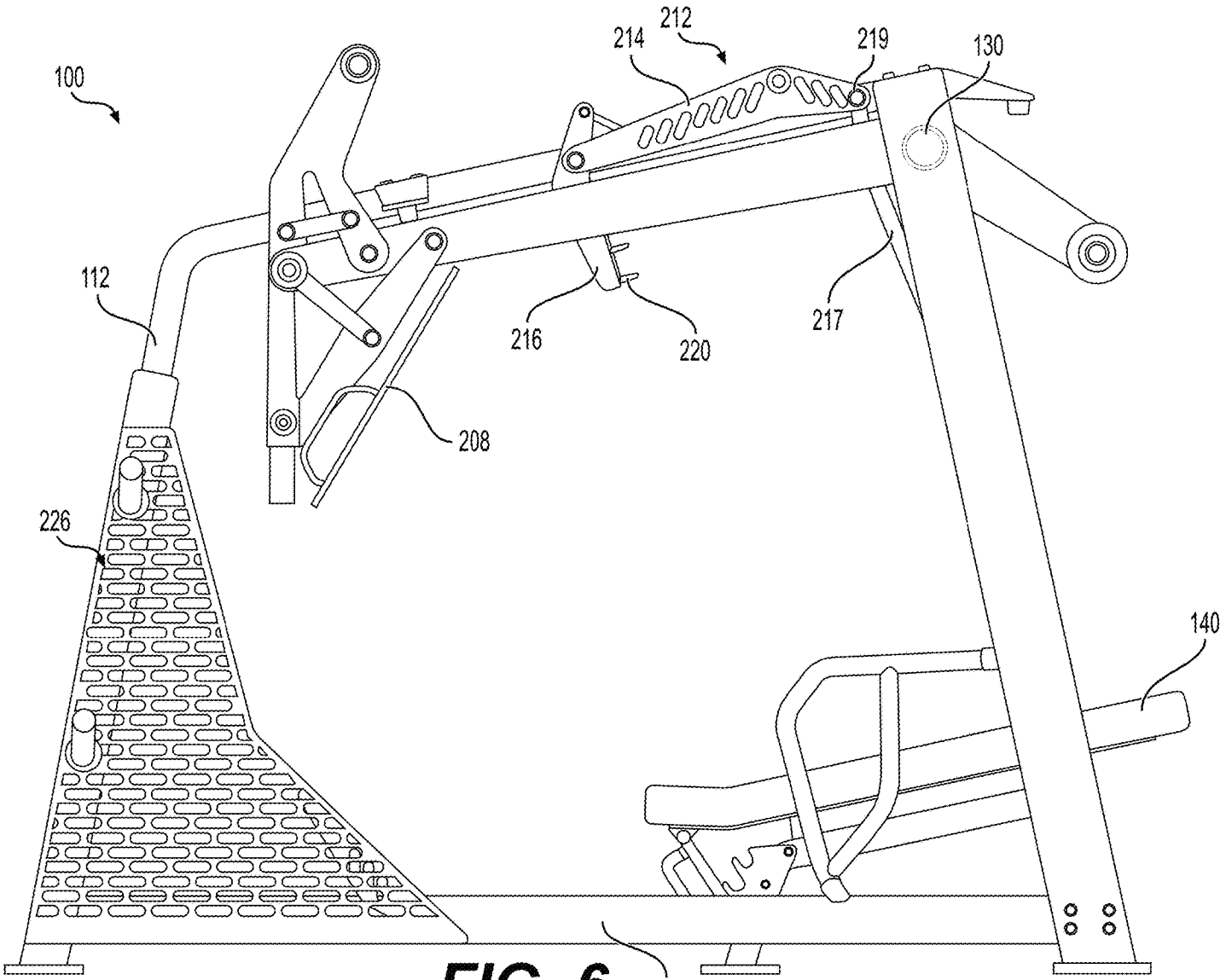
FIG. 6 is a side view of the horizontal pendulum squat system with the weight pivoting system in an extended position and supported by the latch system.

As shown best in FIG. 2, each arm (e.g. arm 122) includes a counterweight receiver 200 positioned at the end of a rear arm extension 201. The counterweight receiver 200 allows for a user to reduce resistance as they engage with a foot plate 208. In other words, as the user adds more weight to the receiver 200, the overall weight applied during use of the weight pivoting system is reduced to the user. Opposite of the counterweight receiver 200, and along the arm 122, are an upper weight receiver 202 and a lower weight receiver 204. These receivers 202, 204 are used to increase resistance against the user. A brace 206 extends substantially upward from the arm 122 to couple the upper weight receiver 202 to the arm 122.

The foot plate 208 is coupled to the arms 122, 124 and is utilized to press into the weighted resistance while the user lies on the bench 140. As shown in at least FIG. 3, the foot plate 208 comprises two independent sides, each independently engaged with one of the arms 122, 124, which again allows for unilateral movement. During use, the user will lie on the bench 140, raise their feet and legs upward to engage with the foot plate 208 (either both legs or just one), and bend their knees (or just one knee) and then extend their knees (or just one) repeatedly to achieve a workout. The foot plate 208 is coupled to the arms 122, 124 via a foot plate support members, for example member 210.

The system 100 also includes a latch system 212 utilized to lock the weight pivoting system 118 in the extended position for storage and when not in use. The latch system 212 includes a catch arm 214 attached to a catch 216 at a pivot connection 218. The catch arm 214 is further coupled to one or more handles 217 at a pivot connection 219, the handles 217 extending downward toward the bench 140. During operation, the user will lie on the bench 140 and raise their feet and legs to the foot plate 208, wherein the user will slightly apply force to the foot plate 208, thereby lifting the weight pivoting system 118 slightly. This movement relieves weight applied to the catch 216 and the user can pull down on the handles 217 to pivot the catch arm 214 which in turn pivots the catch 216, thereby fully disengaging the catch 216 from the arms 122, 124 and allowing the arms to freely move with force from the user. In embodiments, one or more shelves 220 extend from the catch 216 and are configured to support a catch bar 152 extending from each of the arms 122, 124. The latch system 212 is mounted to the top surface of the support bar 120 via a mount 154.

The bench 140 is also adjustable via any means known in the art. For example, a handle 221 may be coupled to a bar 222 which selectively rests within one of a plurality of grooves 224. Adjustment altering an angle of the bench.

In embodiments, the frame structure 102 also includes one or more side panels 225, each with a plurality of notches 226 cut through a thickness of the side panels. These notches 226 allow for securement of any number of accessories onto the frame structure 102. The notches 226 configured to receive hooks or similar structural members of accessories for convenient storage.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations. Not all steps listed in the various figures need be carried out in the specific order described.

The invention claimed is:

1. A horizontal pendulum squat system, comprising:

a frame structure having at least one or more bottom members and one or more substantially vertical members supporting a cross bar;

a weight pivoting system supported by the cross bar and configured to rotate at one or more connection points with the cross bar, the weight pivoting system having:

one or more weight arms connected at the one or more connection points such that the one or more weight arms can rotate about the one or more connection points; and at least one platform coupled to the one or more weight arms, the at least one platform is configured to receive a user applied force;

a bench positioned substantially underneath the weight pivoting system;

wherein the at least one platform is positioned to receive the user applied force while a user is lying on the bench and applying the user applied force with legs and feet of the user against the at least one platform; and wherein the weight pivoting system rotates around the one or more connection points during repetitive motion by the user.

2. The system of claim 1, wherein the frame structure further comprises:

the at least one or more bottom members including a first bottom member and a second bottom member extending from a front end of the horizontal pendulum squat system to a rear end of the horizontal pendulum squat system;

the one or more substantially vertical members including a first rear member and a second rear member respectively coupled to a rear end of the first and second bottom members, the first and second rear members respectively extending substantially upward from the first and second bottom members; and the cross bar extending between a top end of the first and second rear members.

3. The system of claim 2, wherein the one or more weight arms further comprises:

a first weight arm coupled to the cross bar via a first hinge; and a second weight arm coupled to the cross bar via a second hinge.

4. The system of claim 3, wherein the first weight arm further comprises:

a weight end having one or more first weight receivers for increasing resistance to the user; and a counterweight end having one or more second weight receivers for decreasing resistance to the user.

5. The system of claim 3, wherein the frame structure further comprises a support bar coupled to the cross bar and extending substantially perpendicular to the cross bar from the rear end of the horizontal pendulum squat system to the front end of the horizontal pendulum squat system.

6. The system of claim 5, wherein the weight pivoting system further comprises a latch system configured to retain the first weight arm and the second weight arm in a stationary configuration.

7. The system of claim 6, wherein the latch system further comprises:

one or more catch arms coupled to the support bar via a mount;

a catch extending substantially downward from the one or more catch arms, the catch having one or more shelves configured to engage and disengage with the first weight arm and the second weight arm such that the catch either retains the first weight arm and the second weight arm in the stationary configuration or releases the first weight arm and the second weight arm to allow the first weight arm and the second weight arm to rotate around the first hinge and the second hinge when operated by the user.

8. The system of claim 7, wherein the latch system further comprises one or more handles coupled to the one or more catch arms and extending downward toward the bench, wherein the one or more handles are configured such that a pulling force applied to the one or more handles pivots the one or more catch arms which further pivots the catch such that the catch disengages from the first weight arm and the second weight arm.

9. The system of claim 5, further comprising a stop bracket mounted to a top surface of the support bar, the stop bracket having a first bracket bumper and a second bracket bumper, the first and second bracket bumpers providing a stop for the first weight arm and the second weight arm such that the first and second weight arms cannot rotate past the first bracket bumper and the second bracket bumper when the user applied force is applied to the at least one platform.

10. The system of claim 5, further comprising a first bumper extending rearward from the cross bar and a second bumper extending rearward from the cross bar, the first and second bumpers providing a stop for the first weight arm and the second weight arm such that the first and second weight arms cannot rotate past the first bumper and the second bumper when the user applied force is removed from the at least one platform.

11. The system of claim 1, wherein the frame structure further comprises one or more side panels positioned at a front end of the frame structure, the one or more side panels having a plurality of notches.

12. The system of claim 1, further comprising one or more weight storage bars extending from the frame structure and configured to receive and hold weights for storage.

13. The system of claim 1, further comprising:

a bench support bar positioned underneath the bench;

a first shoulder pad extending from the bench support bar on a first side of the bench;

a second shoulder pad extending from the bench support bar on a second side of the bench;

a first handle assembly positioned on the first side of the bench; and a second handle assembly positioned on the second side of the bench.

14. The system of claim 1, further comprising a stationary foot platform positioned below the weight pivoting system and supported on a lower cross bar as part of the frame structure.

* * * * *